United States Patent [19]

Willman

[11] 4,390,067

[45] Jun. 28, 1983

[54] METHOD OF TREATING RESERVOIRS CONTAINING VERY VISCOUS CRUDE OIL OR BITUMEN

[75] Inventor: Bertram T. Willman, Calgary, Canada

[73] Assignee: Exxon Production Research Co., Houston, Tex.

[21] Appl. No.: 251,587

[22] Filed: Apr. 6, 1981

[51] Int. Cl.[3] ..... E21B 43/24

[52] U.S. Cl. ..... 166/245; 166/50; 166/272

[58] Field of Search ..... 166/50, 272, 252, 245, 166/271, 273, 274, 263

[56] References Cited

U.S. PATENT DOCUMENTS

| | | | |
|---|---|---|---|
| 3,259,186 | 7/1966 | Dietz | 166/272 X |
| 3,285,335 | 11/1966 | Reistle, Jr. | 166/272 X |
| 3,349,844 | 10/1967 | Rhea et al. | 166/252 |
| 3,486,559 | 12/1969 | Flickinger et al. | 166/252 |
| 3,500,917 | 3/1970 | Lehner et al. | 166/272 |
| 3,682,244 | 8/1972 | Bowman | 166/272 X |
| 3,960,213 | 6/1976 | Striegler et al. | 166/50 |
| 3,986,557 | 10/1976 | Striegler et al. | 166/50 X |
| 4,074,757 | 2/1978 | Felber et al. | 166/272 X |
| 4,303,126 | 12/1981 | Blevins | 166/50 X |

*Primary Examiner*—Stephen J. Novosad
*Attorney, Agent, or Firm*—E. T. Wheelock

[57] ABSTRACT

A method for treating a field containing viscous oil or bitumen for subsequent production is described. The steps central to the process are drilling a horizontal well within the oil-bearing stratum, and heating the oil in the vicinity of the horizontal well to produce a hot liquid corridor. The open borehole is filled and the oil in the heated corridor is displaced from one end to the other. The corridors may be connected in various configurations to effectively displace a high percentage of oil in a particular field.

21 Claims, 11 Drawing Figures

METHOD OF TREATING RESERVOIRS CONTAINING VERY VISCOUS CRUDE OIL OR BITUMEN

BACKGROUND OF THE INVENTION

This invention relates to a novel method of treating subsurface deposits containing heavy or viscous oil so that it may be recovered using hot fluid displacement techniques.

There exist throughout the world major deposits of heavy oils which, until recently, had been substantially ignored as sources of petroleum since the oils contained therein were not recoverable using ordinary production techniques. For instance, only lately has much interest been shown in the heavy oil deposits of Alberta province in Canada even though the deposits are both close to the surface and represent an estimated petroleum resource upwards of many billion barrels. The expense involved in the production of these oils stems from the fact that they are quite viscous at reservoir temperatures. A viscosity of 10,000 centipoise to several million centipoise characterizes Athabasca crude oil. Unless the deposit is on the surface and the heavy-oil-containing material can be mined and placed in a retort for separation from its matrix, some method of treating the deposit in-situ need be utilized for the realization of any substantial petroleum recovery.

Interwell displacement has been recognized as the most efficient method of in-situ recovery of heavy oils. However, before displacement can commence, a warm and liquid communicating path must be established between wells since viscous oil will not flow at any commercial rate until its viscosity is reduced by heat. In-situ or reservoir heating to try to create this communicating path is generally done by steam stimulation, i.e., injection of steam at above fracturing pressure and subsequent production, on an individual well basis. This process does not result in a well defined heated volume. Since the steam is injected into the formation above fracture pressure, the steam takes the unpredictable path of least resistance in the often unconsolidated strata containing the viscous oils. Consequently, oil which would be recoverable by the present invention is not produced. For these reasons it is a formidable task to recover a substantial percentage of the heavy oil in a selected formation while efficiently utilizing available steam. This invention is intended to provide an effective manner for treating and recovering viscous oils.

A number of methods have been suggested for in-situ thermal recovery of viscous oil deposits.

One of the earliest methods entails the steps of first, drilling a single vertical borehole into the petroleum-bearing formation and then injecting a heated fluid such as steam or water into the formation thereby causing the hydrocarbon to become less viscous and flow. The thusly-heated hydrocarbon is finally pumped from the same vertical borehole. Obviously this method is slow, since there is no mean hydraulic force to continually urge the oil towards the wellbore and no source of heat to maintain it in a liquid, or at least pumpable, state. For these reasons, the proportion of petroleum that can be recovered from a particular formation is quite low.

Another early suggestion, in U.S. Pat. No. 3,349,845, to Holbert et al, provides a somewhat complicated method for recovering viscous oils from shale formations. The process entails first drilling a vertical injection well and thereafter forming a system of vertical fractures which, if desired, may be propped open with sand or other granular solids. A horizontal, or output well, is then drilled to intersect the vertical fracture system. A heated petroleum corridor is established by heating the injection well under a low gas pressure. The heating is continued until a zone at least 40 or 50 feet along the wall of the vertical injection well is created. Holbert et al suggests that the entire stratum between injection and output well can be heated but that is usually neither necessary nor desirable. The fractures are then plugged at the injection well. Plugging provides assurance that the subsequently added displacement fluid, which may be steam, displaces the oil into the output well rather than merely flowing through the fractures.

Holbert et al, although alleging the utility of its disclosed process with respect to tar sands, is apparently quite specific to oil shales and of only minor relevance to tar sands. For instance, vertical fracturing is a required step in the process, and yet U.S. Pat. No. 4,020,901, to Pisio et al, indicates that attempts to fracture tar sand formations in a controllable manner do not meet with success. Vertical fractures often terminate uselessly at the surface. The fractures often tend to "heal" as mobilized viscous petroleum flows through the cracks and cools to its immobile state. Pisio et al, additionally mentions that tar sands frequently underlie intermediate overburden layers which are easily fractured.

The Holbert et al process is not particularly useful at a viscous oil deposit such as that found at Athabasca. Much of the Athabasca tar sands are at a depth too deep to mine and much too shallow to create suitable fractures.

Holbert et al additionally suggests propping open the fractures with some known proppant such as sand. When the stratum under consideration is oil shale, propping is a step which facilitates oil flow. However, in the case of a tar sand which is composed of a viscous oil and sand, the use of sand as a proppant is somewhat akin to "carrying coals to Newcastle." The proppant supply becomes part of the sand matrix and the fracture closes.

Finally, it is generally accepted that fracturing an unconsolidated formation such as by tar sand gives unpredictable results, at least with regard to the orientation of the fracture. On the other hand, consolidated formations, such as the oil shales of Holbert et al, can be fractured with reasonably predictable results. The disclosure in Holbert et al requires knowledge of the fracture's orientation so that the horizontal output well can be drilled to intersect the fractures. Knowledge of fracture orientation is unconsolidated tar sands is not, as a rule, available.

A subsequent development is found in U.S. Pat. No. 3,386,508, to Bielstein et al. This process for recovering viscous crude oils involves sinking a large central well, having a bore diameter of 1 to 10 feet, into a subsurface formation containing oil. A number of injection wells are then slant-drilled to intersect the central well within the subsurface oil-bearing stratum. Steam is then introduced into the injection wells only at the upper end of the stratum. Displaced heated oil permeates the walls at the lower end of the injection wells and passes into the central well where it accumulates and is pumped to the surface.

Bielstein et al does not heat an open horizontal borehole and then plug it as is done in the process of the present invention.

An additional set of related developments is found in U.S. Pat. Nos. 3,994,340; 4,020,901; and 4,037,658, to Anderson et al, Pisio et al, and Anderson respectively. Each produces a heated horizontal corridor by the physical placement of long heat exchangers in the tar sand stratum. The three differ from each other principally in the design of their heat exchangers. Each of these specifications additionally discusses the production problems which are unique to tar sands including the difficulty, mentioned above, of creating and maintaining an effective fracture network. None of the three suggests the straightforward and simple method of treating the petroleum-bearing stratum disclosed herein.

Other methods of attaining corridors of heated viscous petroleum, from which the heated oil can be displaced, are known. For instance, U.S. Pat. Nos. 4,010,799 and 4,084,637, to Kern et al and Todd respectively, teach a process in which a number of vertical wells are drilled down into the oil-bearing stratum, electrodes are inserted into the wells, and a voltage imposed across the electrodes in adjacent wells. Although it is understood that a prototype well involving such a process has been drilled, it is apparent that complete control of a resulting heated chamber position is not readily possible. The electric current will take the path of least resistance irrespective of where the driller would place the chamber. This problem is especially pronounced in areas where oil-bearing formations lie in close vertical proximity to electrically-conductive aquifers.

SUMMARY OF THE INVENTION

This invention relates to a method of treating subsurface formations containing viscous oil, heavy oil, or bitumen so that those oils may be recovered in a reliable manner during a subsequent production operation. This invention, in its simplest form, calls for preparing the oil deposit by drilling a relatively horizontal borehole for a distance within the oil-bearing stratum, heating the length of the borehole with an appropriate fluid, filling the borehole with a substantially nonporous material, and thereby producing a zone or corridor containing heated oil which is subsequently recoverable by known displacement techniques.

Since the heated corridors produced by the inventive treatment process are so well-ordered, recovery techniques using a grid-like pattern of injection and production wells are possible. Effective use of such a pattern results in a high percentage of petroleum recovery.

The inventive process has the advantage of being usable in being thin and thick oil-bearing strata as well as in those which are adjacent to water-bearing layers.

DESCRIPTION OF THE PREFERRED EMBODIMENTS

A central feature of the inventive process rests in the attainment of a heated oil corridor within the oil-bearing stratum by the steps of drilling a horizontal borehole which extends for a distance within the subject stratum, heating the borehole and oil in its environs, and effectively plugging the heated horizontal borehole. A displacement fluid, such as steam, may subsequently be injected at one end of the heated corridor and displaced oil produced at the other. Plugging the horizontal borehole provides assurance that the displacement fluid performs its desired function rather than running uselessly through an open horizontal borehole.

This invention is not limited to a single horizontal heated chamber having an injection well at one end and a producing well at the other. It is normally desirable to lay out a particular field so that various horizontal heated corridors intersect in a chosen manner within the oil-bearing stratum. In this way the associated injection and production wells can serve multiple duty. A single displacement fluid injection well is then able to inject fluid directly or indirectly into a number of heated corridors and a single production well similarly may service a number of corridors. A number of well patterns suitable for optimum utilization of the invention are disclosed below.

For the purposes of this disclosure, a repeating layout of injection and production wells as connected by horizontal heated corridors is known as a "pattern". The surface wells in such a "pattern" are known as "spots". Hence a "five spot pattern" is a layout of five surface wells interconnected in some manner by heated corridors in the oil-bearing stratum. An "array" will be a collection of "patterns" possibly interconnected and possibly not.

Several alternative well patterns are contemplated as suitable for attainment of the desired heated corridors and having a configuration of injection and production wells satisfactory for subsequent production. In dealing with a petroleum-bearing stratum extending over a large area, it may be necessary to make a determination, based on the economics of the field, whether to produce the field with a large number of wells arranged in an array of well patterns, each having injector and producer wells, or simply with a single large pattern. The well configurations disclosed herein are suitable for both single patterns and multiple pattern fields. The consideration of well spacings, i.e., whether to use a single large pattern or multiple small ones, is a normal one in developing any oil field whether using this invention or other more conventional techniques.

Figure 1A:
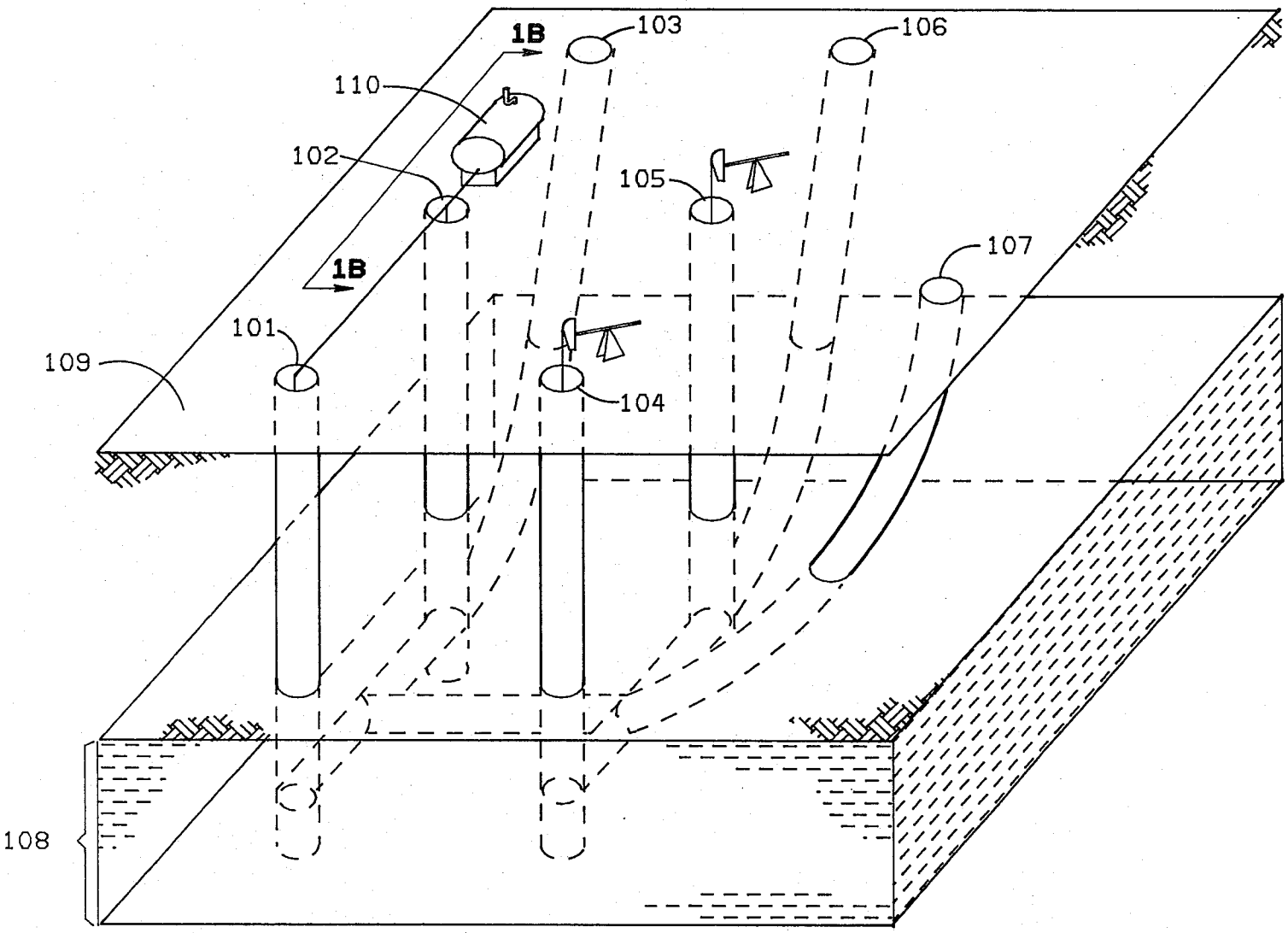
FIGS. 1A and 1B show a seven-well configuration or seven spot repeated pattern, in cutaway perspective and vertical section respectively, useful for practicing the present invention.
Figure 1B:
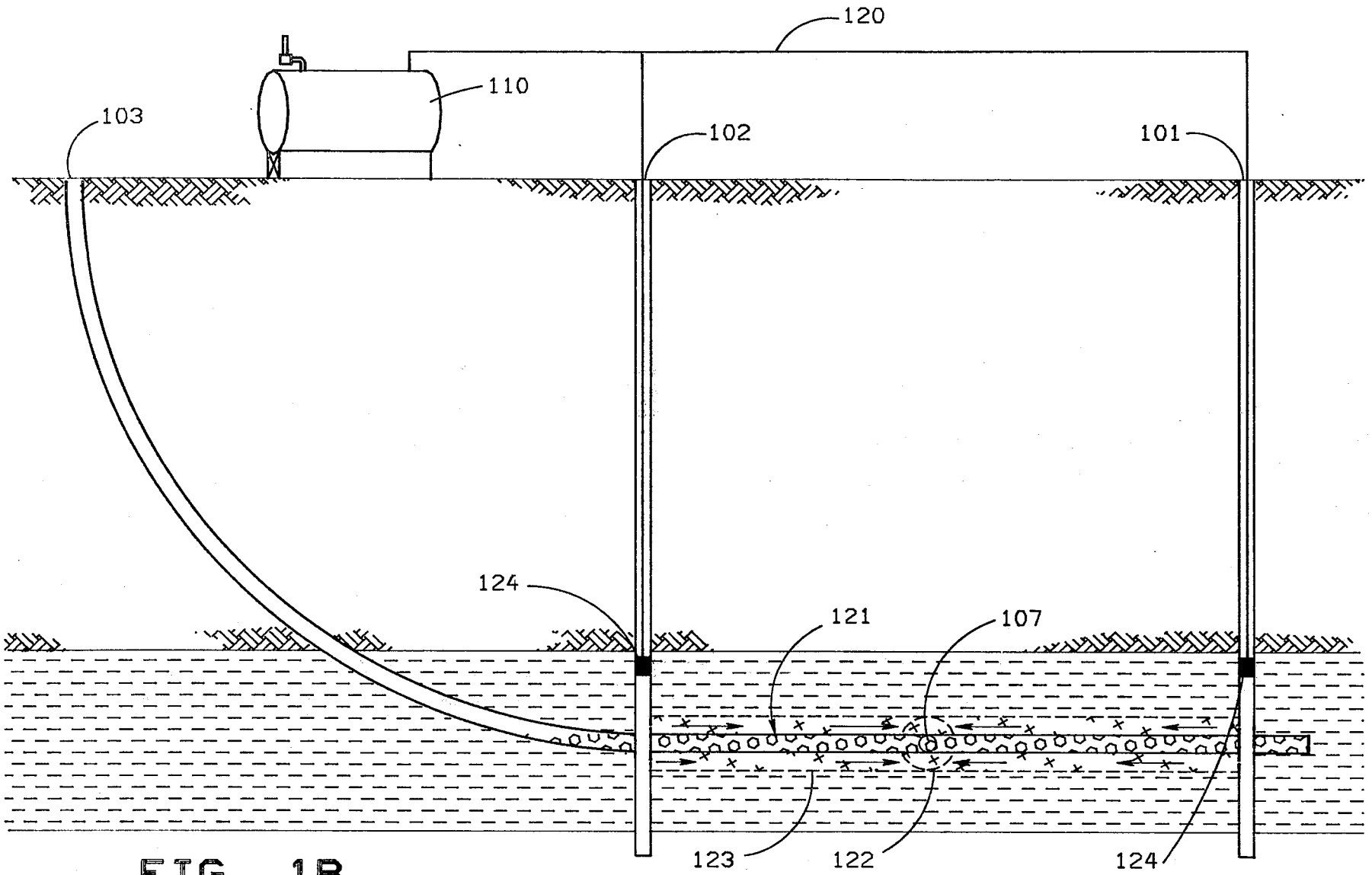

One particularly useful well pattern is schematically depicted, in cutaway shadow perspective, in FIG. 1A and in vertical cross-section, as viewed from the injection well end of the pattern, in FIG. 1B. The use in a particular field of well patterns, such as the one in FIGS. 1A and 1B, in an interconnected array is discussed in some detail in conjunction with FIG. 4.

The seven spot pattern shown in FIG. 1A is produced by drilling four approximately vertical wells 101, 102, 104, and 105 down from the surface 109 substantially into the oil-bearing stratum 108. The spacing of these wells, as mentioned above, is determined by the economics of recovery in the particular field. The economic considerations would include such diverse information as the thermal conductivity of the oil stratum, viscosity of the heated oil, thickness of the oil stratum, and the type of horizontal drilling equipment available. In any event, horizontal distances between wells can be up to 1,000 feet or more in an oil stratum of about 150 feet. Horizontal wells 103 and 106 are then drilled to intercept, respectively, vertical wells 101, 102 and 104, 105 within the oil strata. A third horizontal well 107 is drilled which intersects the horizontal legs of wells 103 and 106 approximately halfway between their respective vertical wells. Methods for drilling horizontal wells are well known in this art and one suitable method is discussed at some length in Holbert et al, supra. Although the vertical placement of the horizontal wellbores within the stratum is not particularly critical, it is highly desirable to place them in the approximate vertical center of the stratum. The oil in many Canadian fields has a formation temperature of 45°-55° F. By placing the horizontal boreholes in the center, less of the applied heat entering via the heating stream is lost to the surrounding non-productive strata. Consequently, the heated channel will be larger in diameter.

The term "intercept", in referring to boreholes in this specification, is intended to include not only those boreholes which actually interconnect, but also those which are or will be effectively connected by a heated channel. For instance, vertical well 101 "intercepts" horizontal well 103 if it passes through the region about horizontal borehole 103 that eventually becomes a heated channel.

The order in which the wells are drilled is not important. It is contemplated that in some instances the vertical wells may be drilled during the time the horizontal wells are undergoing heat treatment or even thereafter.

In any event, before heating the horizontal legs of wells 103, 106 and 107 to establish the heated corridors, the wells should be cased and perforated. A steam injector of tubing may be inserted to near the end of those wells. Steam may then be introduced into the well through the tubing and condensate removed up through the annulus. Less desirably, since more heat will be lost to unproductive upper strata, the steam may be injected in the annulus and condensate returned up the tubing.

Vertical wells 101, 102, 104, and 105 are cased and also perforated within the oil-bearing stratum. It may be necessary to heat the perforated portion of a vertical well to provide assurance that either the vertical well or the heated region around the vertical well intersects the heated corridor around the horizontal leg. For instance, it may be necessary to heat the portion of wells 101 or 102 within the oil-bearing layer illustrated in FIG. 1B. Drilling is an inexact science and consequently well 103 may miss wells 101 or 102. Heating wells 101 or 102 to create a continuous hot oil corridor therebetween allows wells 101 and 102 to be used as injector wells.

The heating step should be continued until an amount of heat approximately equal to that found in 50-100 barrels of steam per linear foot of horizontal wellbore has been introduced into the formation. The steam may be wet and desirably would have a high temperature and a pressure as high as is possible without reaching the fracturing pressure of the formation. A pulse test should be performed after the heating step is completed to assure the existence of a heated liquid corridor between wells 101 and 102 as well as between wells 104 and 105. Of course, if the pulse test fails to confirm the existence of liquid corridors between the pertinent wells, heating should be started again.

The horizontal borehole is then plugged along its entire length by filling with an effectively nonporous material such as cement or a mixture of clay and rock as, for instance, shown at 121 in FIG. 1B. FIG. 1B depicts the pattern shown in FIG. 1A after the step of heating has been completed and the horizontal portion of well 103 has been plugged with cement 121.

The extent of the now-mobile hot oil corridor is shown at 123 as is the end of the heated corridor 122 associated with intersecting horizontal well 107. Steam of other suitable displacement fluid is heated in a boiler 110 and injected through steam lines 120 and introduced to the heated corridor 123 behind thermal packing means 124 in both wells 101 and 102. Although the use of steam lines 120 and packer 124 is preferable in that the annular spaces surrounding steam lines 120 are fairly effective insulators, injection of a heated displacement fluid directly into the cased vertical wells is acceptable. The heat and hydraulic pressure supplied by the steam tends to displace the heated oil from the ends of chamber 123 down into heated chamber 122 (as shown by the arrows in FIG. 1A) and from there into the two recovery wells, 104 and 105, at the opposite end of heated chamber 122. Although steam is discussed as the displacement fluid throughout this specification, it should be understood that other displacement fluids including hydrocarbon and other solvents, micellar dispersions, and surfactants may be added as desired.

Wells 104 and 105 can, in the alternative, be used as injection wells and wells 101 and 102 used as producers.

Figure 2C:
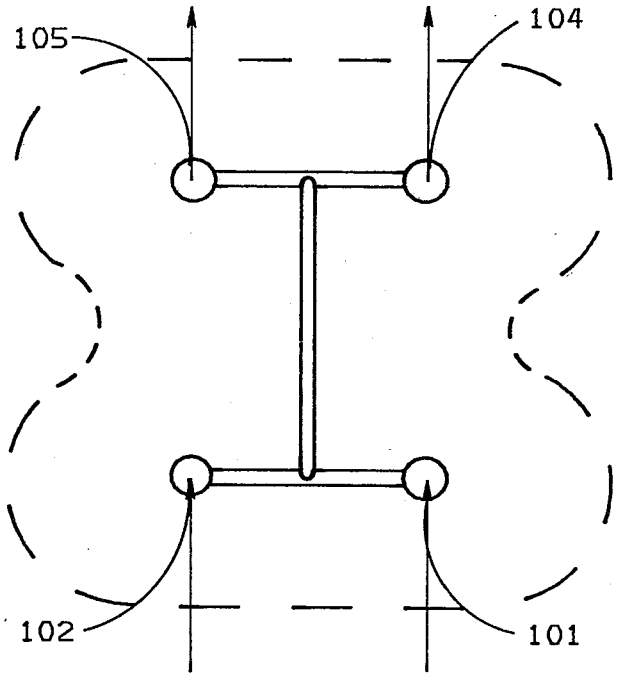
FIGS. 2A–2C show the progression of the shape of an H-shaped heated zone or corridor configuration as oil is displaced.
Figure 2B:
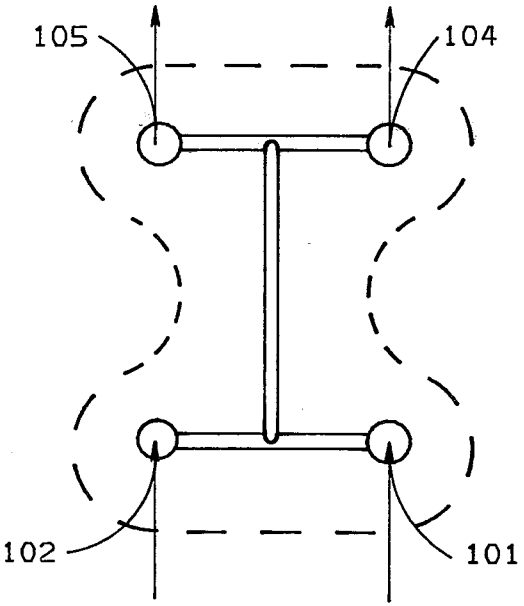
Figure 2A:
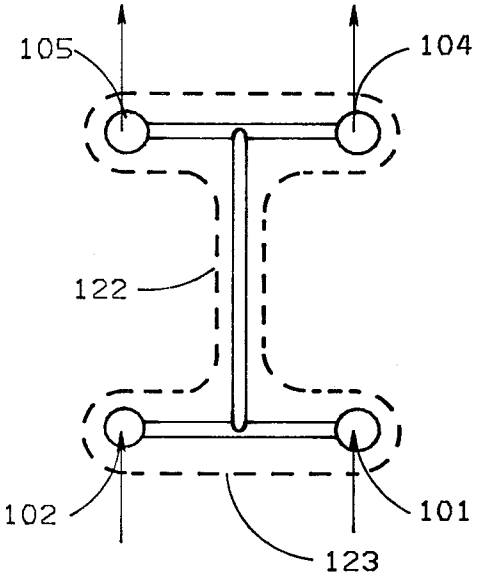

FIGS. 2A-2C are overhead views of the heated corridors, 122 and 123, surrounding wells 101, 102, 104, and 105 as those corridors grow during the production step illustrated in FIGS. 1A and 1B. The H-shaped configuration of the corridors is particularly advantageous to use with the heating step disclosed herein because of the potential for exceptionally high recovery efficiency. As steam displacement of the viscous oil takes place, the hot liquid corridors, e.g., 122 and 123 in FIG. 2A, tend to increase in diameter, and the once-right-angle meeting between corridor 122 and the other corridors begins to smooth in the manner shown in FIG. 2B. Further displacement continues such trend, as shown in FIG. 2C.

Figure 3A:
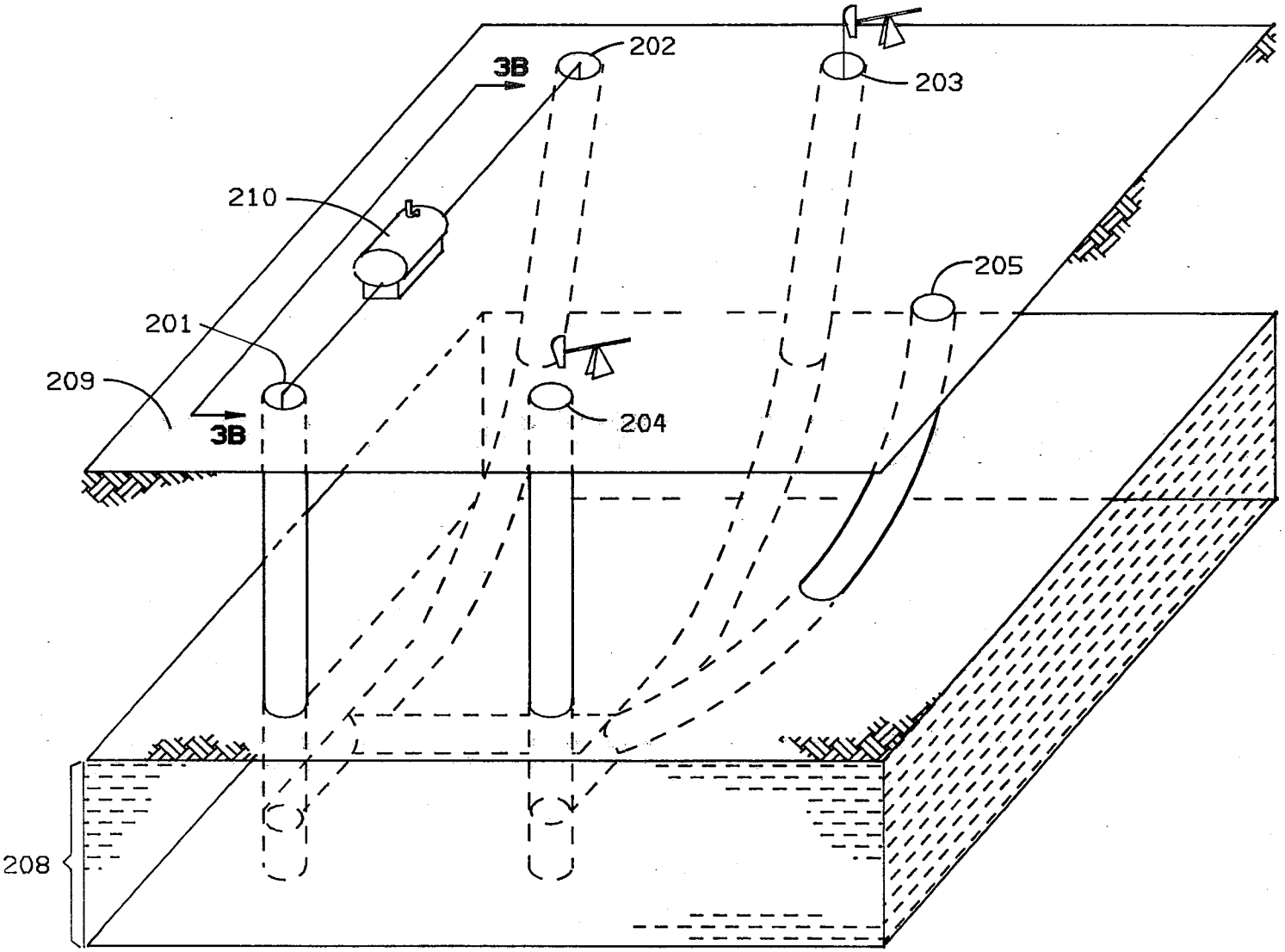
FIGS. 3A and 3B show a five spot repeated pattern in cutaway perspective and vertical section, respectively, useful for practicing the present invention.
Figure 3B:
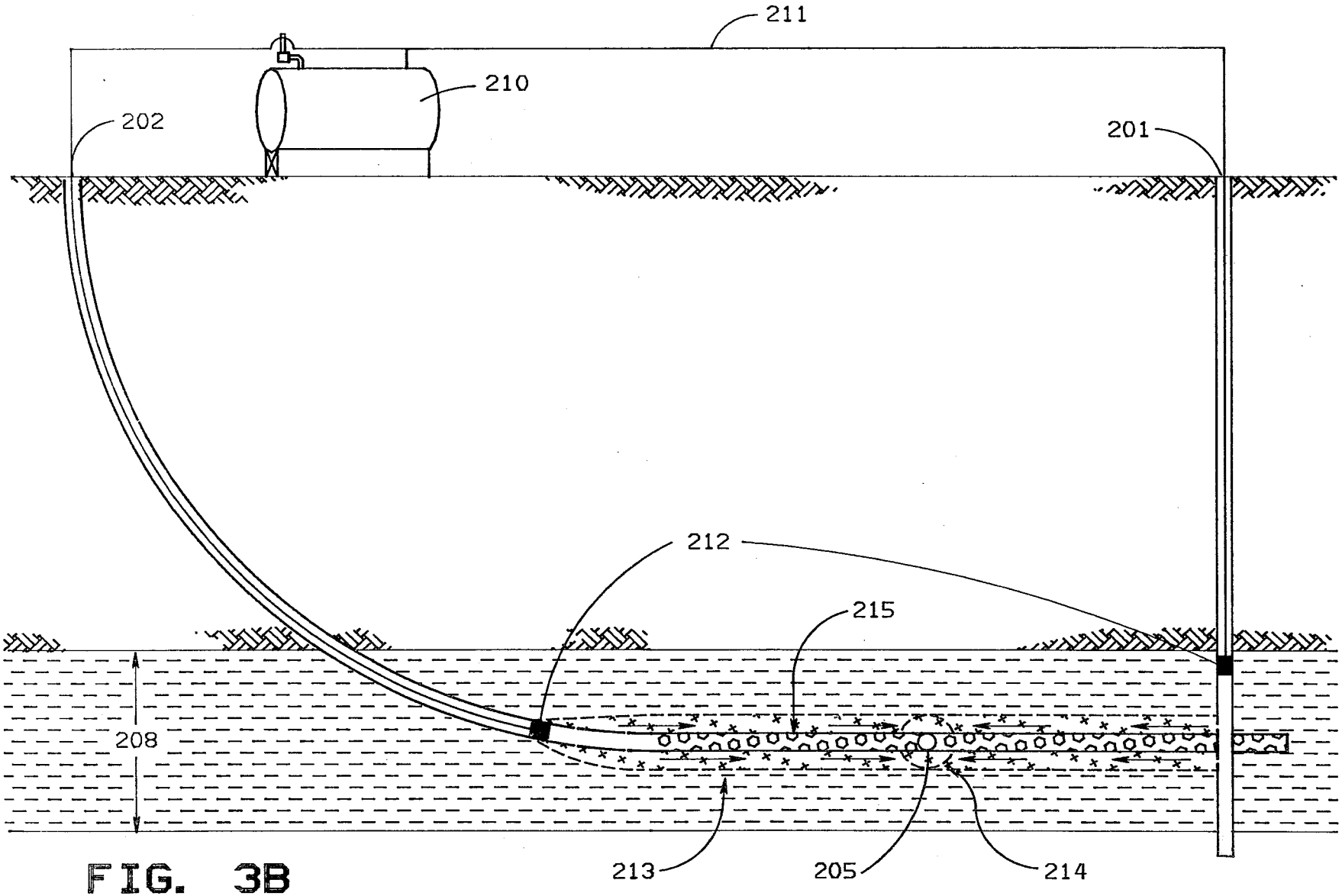

A similar and more desirable well layout producing the H-shaped heated corridors is depicted in FIGS. 3A and 3B. This embodiment, which is especially suitable for a field requiring a single five-spot pattern, uses only two vertical wells, 201 and 204. Horizontal wells 202 and 203, similarly to wells 103 and 106 in FIG. 1A, come down from the surface and take a largely horizontal route through the oil-bearing stratum to intersect wells 201 and 204. Horizontal well 205 intersects both wells 202 and 203 at a predetermined site within the stratum. This embodiment is more desirable than that found in FIGS. 1A and 1B since fewer wells are drilled.

Casing, perforating, and heating the horizontal wellbore is undertaken in a manner similar to that discussed above with regard to the configuration of FIGS. 1A and 1B.

The major significant difference between these embodiments lies in the plugging of the horizontal portions of wells 202 and 203. Only the lower portion of the horizontal bore is filled, with cement or clay and rock, 215 in FIG. 3B, since the subsequent displacement step requires the displacement fluid to come in contact with the heated chamber 213. As in the previously discussed embodiment, the displacement steam is generated in a steam generator 210 and flows through steam line 211 into wells 201 and 202 where it is injected into heated chamber 213 through perforations in the well casings. Packers 212, maintain the steam in contact with the heated bed 213. The steam tends to displace the viscous oil therein towards heated corridor 214 which surrounds plugged horizontal wellbore 205, through corridor 214, and from there into production wells 202 and 203.

Other configurations of injector and producer wells would be apparent to one having skill in the art based on this disclosure and would include such variations as: a single injection well and a single production well coupled by a heated corridor produced by the inventive heating method; a T-shaped configuration having either two injection wells on the cross-bar and one production well on the base of the 'T' or alternatively two production wells on the ends of the cross-bar and one injection well on the base of the 'T', all connected by heated corridors produced by the method of the invention; or a square with wells at each corner and one in the center in which the corners are used either as producer or injection wells and the center, respectively, is used as an injection or producer well.

Figure 4A:
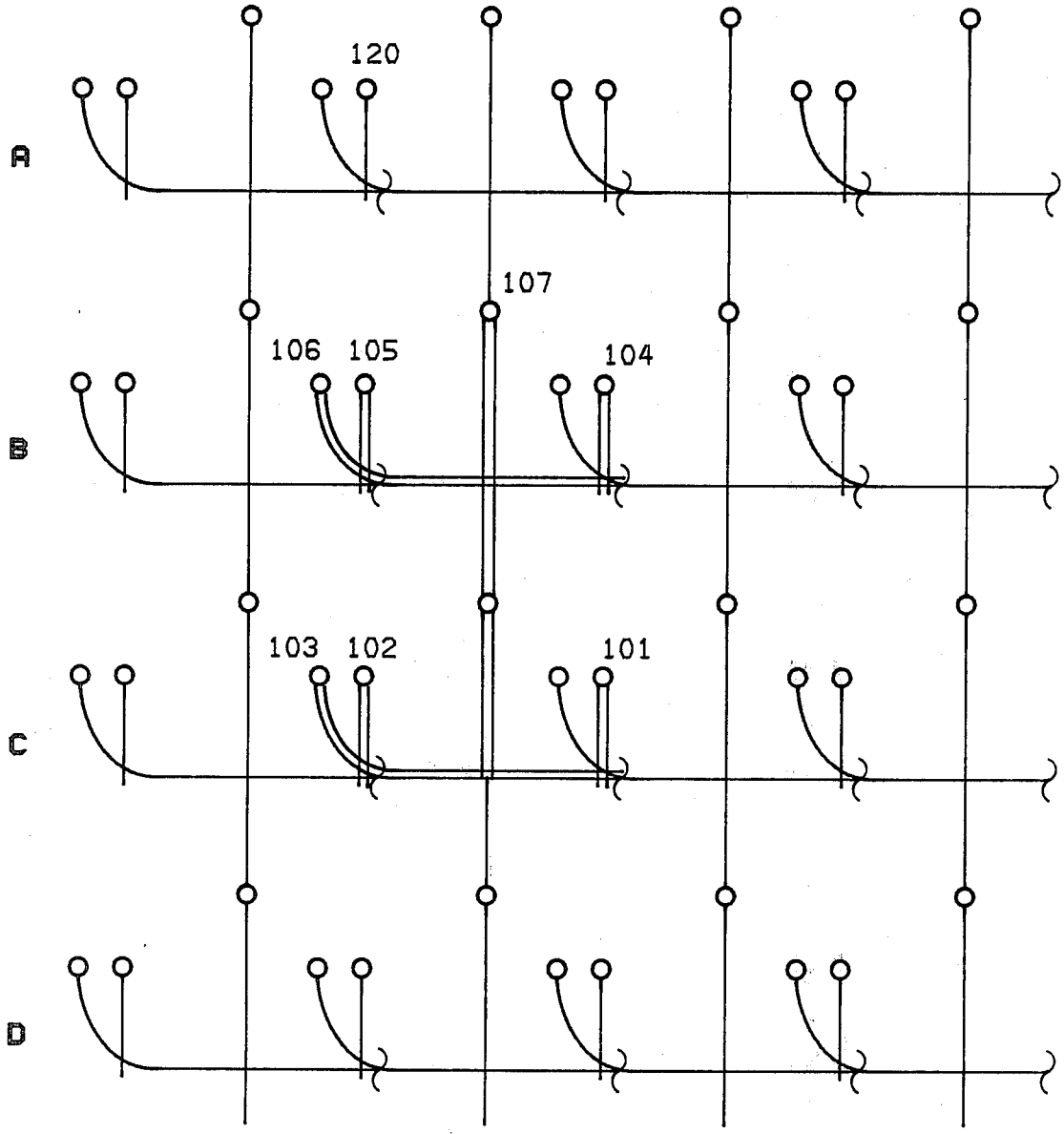
FIG. 4A shows a front semi-elevation of a field having a number of seven spot repeated patterns.
Figure 4B:
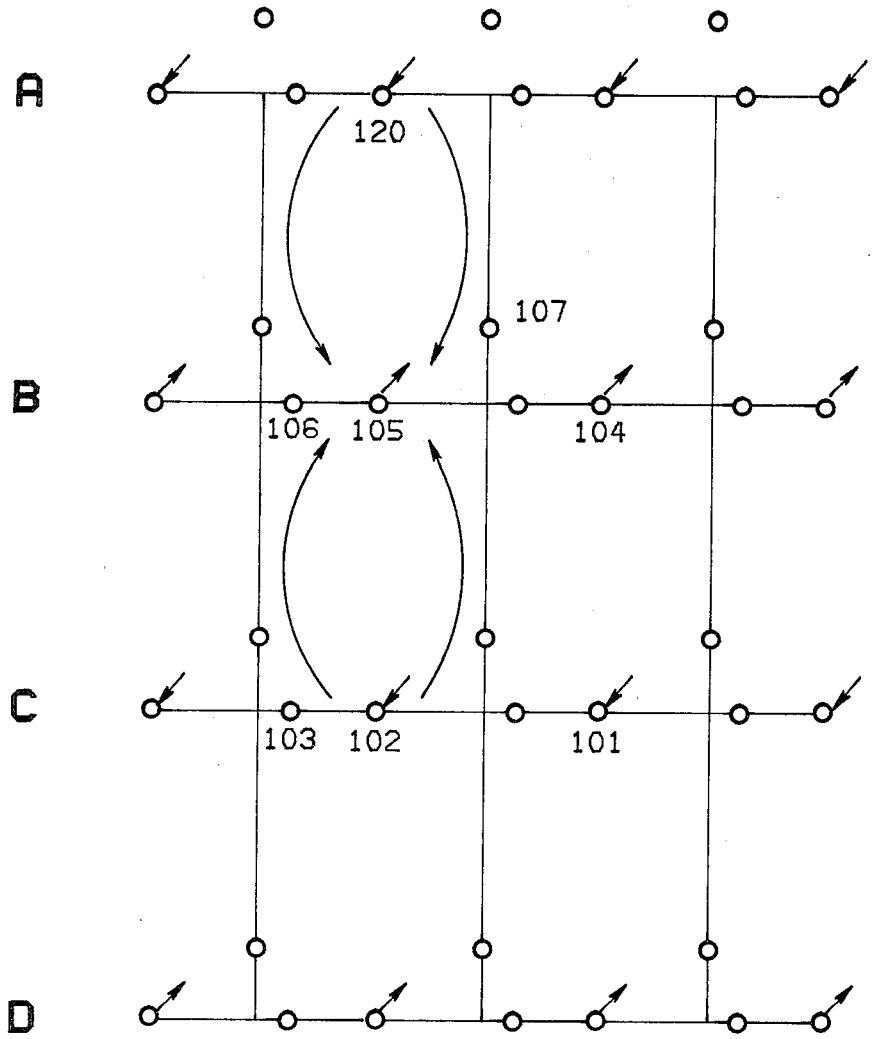
FIG. 4B shows an elevation of the field of FIG. 4A.

Similarly, as mentioned above, it may be desirable to repeat a pattern of injector and production wells so as to effectively deplete a particular field. FIG. 4A provides a semi-elevation of such arrangement using an array of the seven spot pattern depicted in FIGS. 1A and 1B. FIG. 4B provides an aerial elevation of the arrangement of FIG. 4A. Producer wells 104 and 105 are in Row B of FIG. 4B and injection wells 101 and 102 are in Row C. Each well in Rows A and C is an injector well and is in hot corridor communication (as schematicized in the straight lines in the drawing) with the injector wells adjacent to it. Each injector well is in hot corridor communication through the H-network to the producer wells of Rows B and D.

Such an arrangement provides a multitude of sources for heat and hydraulic pressure on the heated oil as it moves towards a production well. For instance, well 105 produces oil displaced by steam from both injector wells 102 and 120 via the paths shown on FIG. 4B.

Figure 5A:
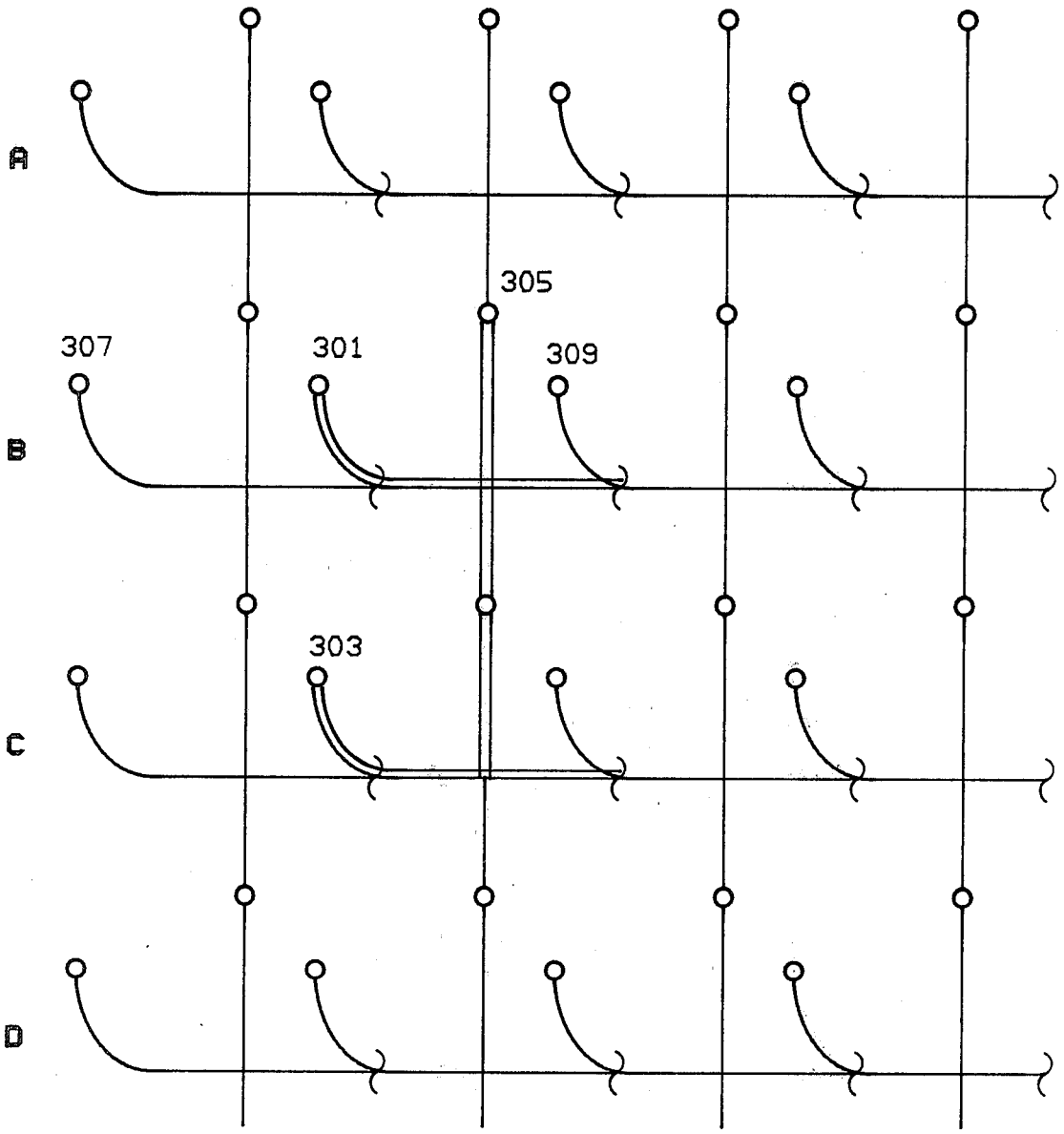
FIGS. 5A and 5B show, respectively, a semi-elevation and an elevation of a field using interconnected 3-spot patterns.
Figure 5B:
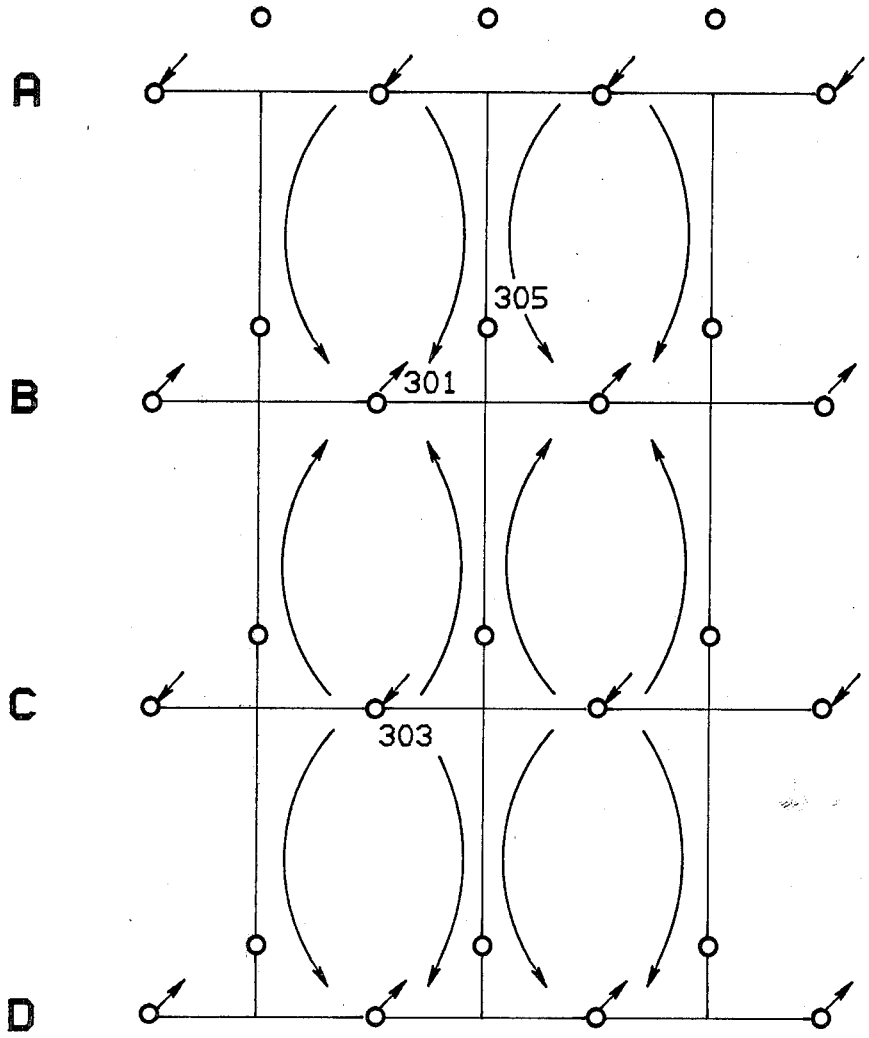

FIGS. 5A and 5B illustrate what could be considered a three-spot pattern which must be used in an interlocking array. The pattern, as shown in FIG. 5A, consists of two relatively parallel horizontal boreholes, 301 and 303, which are interconnected within the oil-bearing stratum by a crossing third horizontal borehole 305 to form a grid-like array. The casing, perforating, heating and plugging steps are executed on these horizontal boreholes in a manner similar to the steps discussed above with respect to the five-spot and seven-spot patterns.

Other horizontal wells are provided which meet so as to form a grid-like network of reasonably continuous horizontal boreholes within the stratum. Thus, the horizontal portion of well 301 meets the horizontal portion of wells 307 and 309 to form a single continuous heated corridor. Some point in the borehole near its entry point into the reservoir is near the termination point of another horizontal well. A similar relationship exists between well 303 and its adjacent brothers and also well 305 and its adjacent wells.

The displacement flow, as shown in FIG. 5B, is more circuituous than in the array illustrated in FIGS. 4A and 4B, but the overall expense is less because of the lower number of wells drilled.

As in FIG. 4B, the wells in rows A and C are used as injection wells and those in rows B and D are producers.

The foregoing disclosure and description of the invention are only illustrative and explanatory thereof. Various changes in size, shape and details of the illustrated construction may be made within the scope of the appended claims without departing from the spirit of the invention.

We claim:

1. A method for treating a field having a reservoir containing viscous oil or bitumen comprising the steps of:

providing at least two boreholes extending downward from the surface at least into the reservoir, providing at least one generally horizontal borehole within the reservoir connecting at least two boreholes extending from the surface, introducing a heated fluid into said horizontal borehole in an amount sufficient to at least soften said viscous oil or bitumen for a distance substantially along said at least one generally horizontal borehole within the reservoir, substantially plugging said at least one horizontal borehole within the reservoir, introducing a heated displacement fluid into at least one borehole extending downward from the surface within the reservoir at the juncture between the plugged borehole said downwardly extending borehole, and withdrawing said viscous oil or bitumen from a borehole extending downward from the surface at a point remote from the displacement fluid introduction point.

2. The method of claim 1 wherein said at least two boreholes extending downward from the surface are substantially vertical.

3. The method of claim 1 wherein at least one of the boreholes extending downward from the surface and at least one of said horizontal boreholes within the reservoir are the same borehole.

4. The method of claim 1 wherein the heated fluid is steam.

5. The method of claim 4 wherein steam pressure in said at least one horizontal borehole approaches or is less than the localized fracturing pressure of the reservoir.

6. The method of claim 4 or 5 wherein steam flow is terminated after 50–100 barrels of steam per linear foot of horizontal borehole in the reservoir have been added.

7. The method of claim 1 wherein the reservoir is vertically adjacent a water-containing layer.

8. The method of claim 1 wherein said at least one horizontal borehole is plugged with either cement or a mixture of clay and rock.

9. The method of claim 1 wherein the heated displacement fluid is steam.

10. A method for producing viscous oil or bitumen from a reservoir containing same comprising the steps of:

providing first, second, third and fourth boreholes extending down from the surface at least into the reservoir, spaced apart in a generally rectangular configuration so that the first borehole is on the corner adjacent the second and the fourth on the rectangle, providing two horizontal boreholes within the reservoir connecting first and second boreholes and third and fourth boreholes, providing a horizontal borehole connecting the horizontal boreholes between first and second boreholes and third and fourth boreholes approximately at the midpoints between first and second boreholes and third and fourth boreholes, introducing a heated fluid into each of the horizontal boreholes in an amount sufficient to at least soften said viscous oil or bitumen, substantially plugging each of said horizontal boreholes within the reservoir, introducing a heated displacement fluid into first and second boreholes at their junction with the plugged horizontal boreholes, withdrawing said viscous oil or bitumen from third or fourth boreholes.

11. The method of claim 10 wherein at least one of the heated fluid and the heated displacement fluid is steam.

12. The method of claim 10 wherein the reservoir is vertically adjacent a water-bearing layer.

13. The method of claim 10 wherein the horizontal wellbores are plugged with a material selected from cement and a mixture of clay and rock.

14. A method for treating a field having a reservoir containing viscous oil or bitumen comprising the steps of:

providing a number of generally horizontal boreholes within a reservoir each having an entry point into the reservoir and a termination point within the reservoir, and arranged in a grid-like array with the termination point of a majority of said boreholes each being in near proximity to the entry point of another horizontal borehole, introducing a heated fluid into each of said horizontal boreholes in an amount sufficient to at least soften said viscous oil or bitumen, substantially plugging each of said horizontal boreholes within the reservoir.

15. The method of claim 14 wherein the heated fluid is steam.

16. The method of claim 15 wherein steam pressure in said horizontal boreholes approaches or is less than the localized fracturing pressure of the reservoir.

17. The method of claim 15 or 16 wherein steam flow is terminated after 50–100 barrels of steam per linear foot of horizontal borehole in the reservoir have been added.

18. The method of claim 14 wherein the reservoir is vertically adjacent a water-containing layer.

19. The method of claims 14, 15, or 18 further comprising the steps of:

introducing a heated displacement fluid into the reservoir at one end of each of said plugged horizontal boreholes, withdrawing said viscous oil or bitumen at a point on said plugged horizontal boreholes remote from the displacement fluid introduction site.

20. The method of claim 19 wherein the heated displacement fluid is steam.

21. The method of claim 14 wherein each of said horizontal boreholes is plugged with either cement or a mixture of rock and clay.

* * * * *